US007588162B2

(12) United States Patent
Dubé et al.

(10) Patent No.: US 7,588,162 B2
(45) Date of Patent: Sep. 15, 2009

(54) STORING CONTAINER

(75) Inventors: Claude Dubé, La Pocatiere (CA); Serge Bisson, Saint-Jean-Port-Joli (CA); Frédéric Michaud, Trois-Rivieres (CA)

(73) Assignee: Rousseau Metal Inc., Saint-Jean-Port-Joli, Quebec (CA)

( * ) Notice: Subject to any disclaimer, the term of this patent is extended or adjusted under 35 U.S.C. 154(b) by 360 days.

(21) Appl. No.: 11/248,563

(22) Filed: Oct. 13, 2005

(65) Prior Publication Data

US 2006/0108368 A1 May 25, 2006

(30) Foreign Application Priority Data

Oct. 13, 2004 (CA) ..... 2481893

(51) Int. Cl.
*B65D 25/04* (2006.01)

(52) U.S. Cl. ..... 220/552

(58) Field of Classification Search ..... 220/552, 220/533, 532, 529, 527, 543, 544, 549, 23.8, 220/23.6, 23.2, 676, 751, 23.83, 482, 481, 220/480, 500; 206/511, 512, 509, 504
See application file for complete search history.

(56) References Cited

U.S. PATENT DOCUMENTS 655,530 A * 8/1900 Vossbeck ..... 249/131
1,336,972 A * 4/1920 Levene ..... 220/318
1,416,287 A * 5/1922 Harrah ..... 220/533
1,451,984 A * 4/1923 Jordan ..... 220/23.83
1,588,271 A * 6/1926 Saint et al. ..... 220/23.2
1,630,140 A * 5/1927 Sibbald ..... 220/552
1,935,941 A * 11/1933 Chandonia ..... 220/23.6
2,061,414 A * 11/1936 Tufts et al. ..... 217/5
2,112,498 A * 3/1938 Wilson ..... 312/352
2,459,940 A * 1/1949 Himmel ..... 220/529
2,641,383 A * 6/1953 Coursey ..... 206/506
2,730,263 A * 1/1956 Neilson ..... 220/482
2,770,513 A * 11/1956 Brown ..... 220/482
3,163,338 A * 12/1964 Gottsegen ..... 224/484
3,187,924 A * 6/1965 Marcus ..... 220/480
3,252,614 A * 5/1966 Evans ..... 206/509
3,326,410 A * 6/1967 Asenbauer ..... 206/504
3,386,608 A * 6/1968 Diller ..... 220/23.6
3,404,805 A * 10/1968 Stockman et al. ..... 206/144

(Continued)

FOREIGN PATENT DOCUMENTS

EP 442730 A1 * 8/1991

*Primary Examiner*—Anthony D Stashick
*Assistant Examiner*—Robert J Hicks
(74) *Attorney, Agent, or Firm*—Merchant & Gould P.C.

(57) ABSTRACT

A container for storing at least one article, the container including opposite front and rear walls, and opposite left and right walls, each of the walls being provided with an inner surface and an outer surface, and having an upper rim. The container also includes a bottom floor. The walls and bottom floor are operatively connected to one another so as to define a main storing space within the container for storing the at least one article. An important aspect of the present invention lies in the fact that the rear wall of the container includes a tongue extending longitudinally along the upper rim of the rear wall, the tongue further extending downwardly from the upper rim of the rear wall and being shaped and sized for hooking the container onto a fixed structure via the tongue.

20 Claims, 6 Drawing Sheets

U.S. PATENT DOCUMENTS 3,661,271 A * 5/1972 Fisher et al. ..... 211/88.01
4,250,665 A * 2/1981 English et al. ..... 47/81
4,287,997 A * 9/1981 Rolfe et al. ..... 220/1.5
4,577,773 A * 3/1986 Bitel ..... 220/533
4,838,445 A * 6/1989 Lanius ..... 220/533
5,215,205 A * 6/1993 Behlman ..... 220/4.31
5,221,001 A * 6/1993 Eisman ..... 206/144
5,377,860 A * 1/1995 Littlejohn et al. ..... 220/790
5,409,127 A * 4/1995 Stratford et al. ..... 220/23.4
D371,238 S * 7/1996 Dingman ..... D3/304
5,584,412 A * 12/1996 Wang ..... 220/500
5,836,043 A * 11/1998 Rovas ..... 15/257.06
D517,319 S * 3/2006 Wisnoski et al. ..... D3/304
7,073,682 B2 * 7/2006 Raches et al. ..... 220/488
2002/0139808 A1 * 10/2002 Grueneberg ..... 220/751
2006/0076355 A1 * 4/2006 Sofy ..... 220/751

* cited by examiner

STORING CONTAINER

FIELD OF THE INVENTION

The present invention relates to a storing container. More particularly, the present invention, in its preferred intended use, relates to a storing container for use in industrial drawers and the like. The present invention also relates to a method of storing at least one article within such a container, as well as to a kit for assembling the same.

BACKGROUND OF THE INVENTION

Storing containers are well known in the art.

Indeed, it is well known in the art that most storing containers only allow a very limited number of applications and/or uses. For example, it is known in the art that conventional storing containers which are typically used in industrial drawers and the like, are not provided with components and features which enable them to remain fixed inside a given drawer during the opening and closing thereof. Thus, a major problem associated with such conventional storing containers is that a result of them moving within a given drawer, and possibly piling up and/or displacing themselves in an undesirable manner, they may cause interference with an adjacent drawer (e.g. top drawer), thereby preventing it from being properly opened or closed. Another problem associated with such conventional storing containers is that they do not enable users thereof to selectively divide up the corresponding storage space and/or to conveniently identify the content thereof.

Hence, in light of the aforementioned, there is a need for an improved container which, by virtue of its design and components, would be able to overcome some of the aforementioned prior art problems, that is, there is a need for a multipurpose container which would enable a greater variety of applications and/or uses than what is possible with storing containers of the prior art.

SUMMARY OF THE INVENTION

The object of the present invention is to provide a container which satisfies some of the above-mentioned needs and which is thus an improvement over other related containers known in the prior art.

In accordance with the present invention, the above object is achieved, as will be easily understood, with a container for storing at least one article, the container comprising:

opposite front and rear walls, each of said walls being provided with an inner surface and an outer surface, and having an upper rim;

opposite left and right walls, each of said walls being provided with an inner surface and an outer surface, and having an upper rim; and a bottom floor having an inner surface and an outer surface;

wherein the walls and bottom floor are operatively connected to one another so as to define a main storing space within the container for storing said at least one article;

the improvement wherein the rear wall of the container comprises a tongue extending longitudinally along the upper rim of the rear wall, said tongue further extending downwardly from said upper rim of the rear wall and being shaped and sized for hooking the container onto a fixed structure via said tongue.

Preferably, the tongue is provided with a hook shaped and sized for hooking onto the upper rim of the front wall of another one of such container.

Preferably also, the container comprises at least one separator, said at least one separator being shaped and sized for inserting into the main storing space of the container for dividing said main storing space into a pair of corresponding smaller storing spaces, the at least one separator being connectable onto opposite walls of the container.

Preferably also, each opposite wall comprise a slot for receiving a bottom portion of the at least one separator and a groove for receiving an upper portion of the at least one separator.

Preferably also, the at least one separator comprises an upper rim, the upper rim of the at least one separator being positioned at a higher lever than the upper rim of the front, left and right walls.

Preferably also, the upper rim of the rear wall is positioned at a higher lever than the upper rim of the front, left and right walls.

Preferably also, either one of the outer surfaces of the front, rear, left and right walls is provided with at least one rib projecting from therefrom.

According to another aspect of the present invention, there is also provided a kit for assembling a container for storing at least one article, the kit comprising:

a container such as the one described and illustrated herein, as exemplified in the accompanying figures; and at least one separator, said at least one separator being shaped and sized for inserting into the main storing space of the container for dividing said main storing space into a pair of corresponding smaller storing spaces, the at least one separator being connectable onto opposite walls of the container.

According to yet another aspect of the present invention, there is also provided a method of storing at least one article, wherein the method comprises the steps of:

a) providing a container such as the one described and illustrated herein, as exemplified in the accompanying figures;

b) separating the main storing space of the container into a plurality of smaller storing spaces by means of at least one separator; and c) inserting the at least one article into one of said plurality of smaller storing spaces.

Preferably also, the method further comprises the step of:

d) labeling the content of a given storing space of the container by affixing an indication on a corresponding rim of the container.

The objects, advantages and other features of the present invention will become more apparent upon reading of the following non-restrictive description of preferred embodiments thereof, given for the purpose of exemplification only with reference to the accompanying drawings.

DETAILED DESCRIPTION OF PREFERRED EMBODIMENTS OF THE INVENTION

In the following description, the same numerical references refer to similar elements. The embodiments shown in the figures are preferred, for exemplification purposes only.

Moreover, although the present invention was primarily designed for use as a storing container within industrial drawers and the like, it may be used with other types of objects, and in other fields, as apparent to a person skilled in the art. For this reason, expressions such as "storing", "container", "industrial", "drawer", etc., used herein should not be taken as to limit the scope of the present invention and includes all other kinds of objects or fields with which the present invention could be used and may be useful.

Moreover, in the context of the present invention, the expressions "container", "box", "device", "assembly", "system", and any other equivalent expression and/or compound words thereof known in the art will be used interchangeably. Furthermore, the same applies for any other mutually equivalent expressions, such as "storing" and "containing", or "separators" and "dividers", for example, as also apparent to a person skilled in the art.

In addition, although the preferred embodiment of the present invention as illustrated in the accompanying drawings may comprise various components such as rims, rounded corners, legs, a tongue with hook, separators, corresponding slits, walls with slots and grooves, legs, ribs, etc., and although the preferred embodiments of the container 1 as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the container 1 and corresponding parts according to the present invention, as will be briefly explained hereinafter and as can be inferred herefrom by a person skilled in the art, without departing from the scope of the present invention.

Broadly described, the present invention, as illustrated in the accompanying drawings, relates to a container 1 to be used for storing at least one article (not shown). As better shown in FIG. 1, the container 1 comprises opposite front and rear walls 3,5, each of said walls 3,5 being provided with an inner surface 3*a*,5*a* and an outer surface 3*b*,5*b*, and having an upper rim 3*c*,5*c*. The container 1 also comprises opposite left and right walls 7,9, each of said walls 7,9 being provided with an inner surface 7*a*,9*a* and an outer surface 7*b*,9*b*, and having an upper rim 7*c*,9*c*. The container 1 also comprises a bottom floor 11 having an inner surface 11*a* and an outer surface 11*b*.

Figure 1:
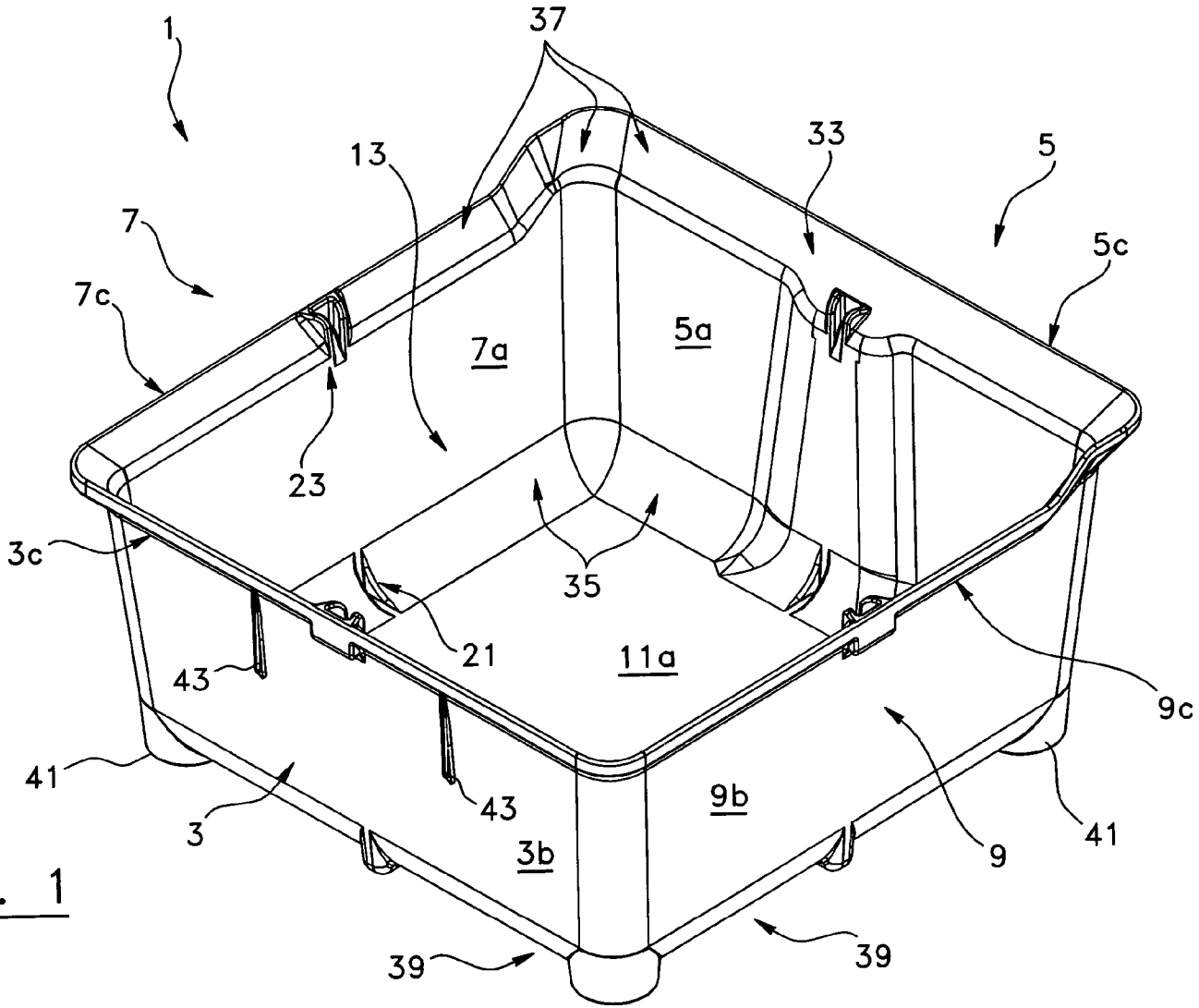
FIG. 1 is a front perspective view of a container according to a preferred embodiment of the present invention.
Figure 7:
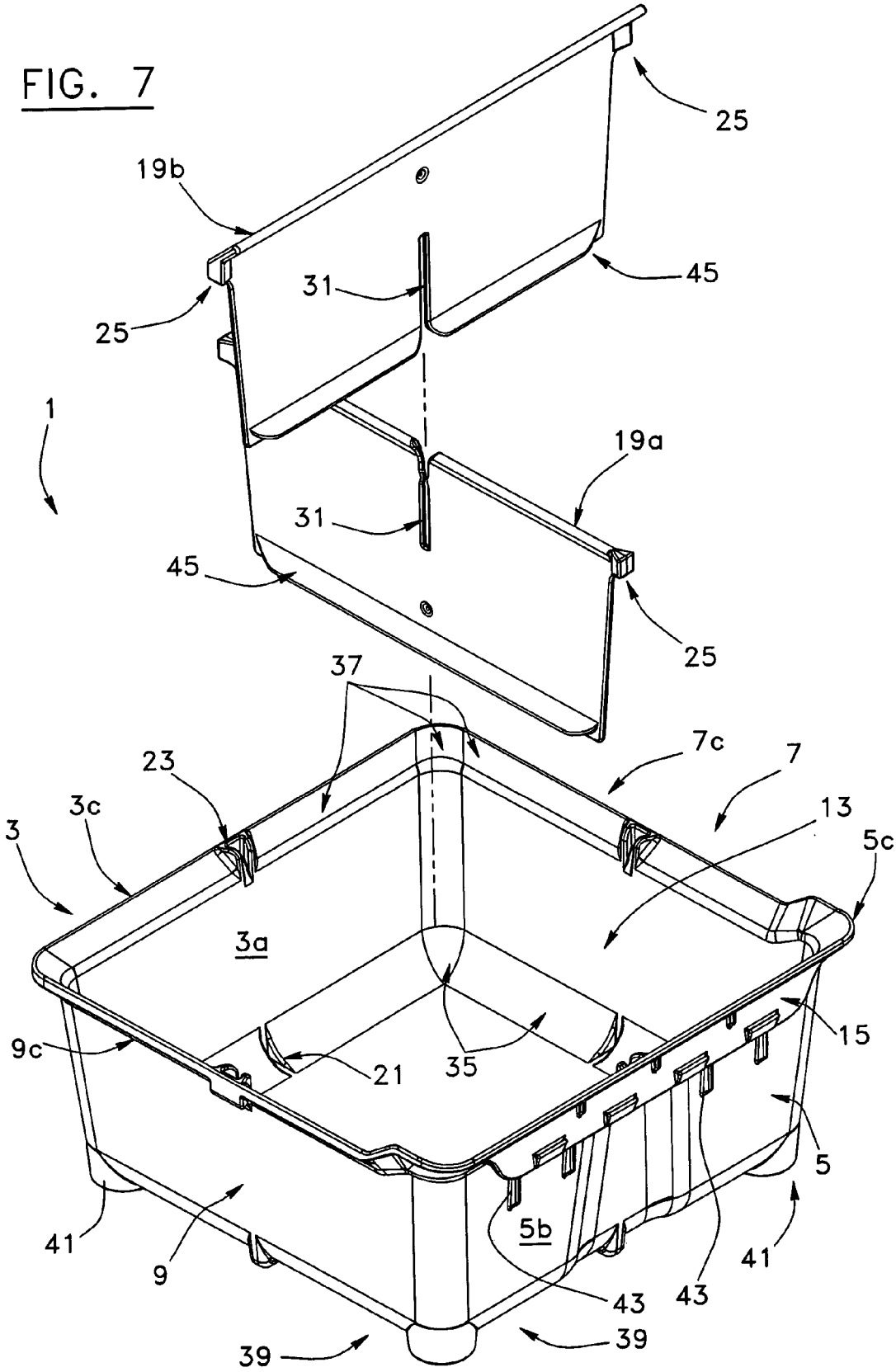
FIG. 7 is a rear perspective and exploded view of what is shown in FIG. 5.

As better shown in FIGS. 1 and 7, the walls 3,5,7,9 and bottom floor 11 are operatively connected to one another so as to define a main storing space 13 within the container 1 for storing one or a plurality of articles. An important aspect of the present invention lies in the fact that the rear wall 5 of the container 1 comprises a tongue 15 extending longitudinally along the upper rim 5*c* of the rear wall 5, said tongue 15 further extending downwardly from said upper rim 5*c* of the rear wall 5 and being shaped and sized for hooking the container 1 onto a fixed structure (not shown) via said tongue 15, as can be easily understood when referring to FIGS. 2 and 3.

Figure 2:
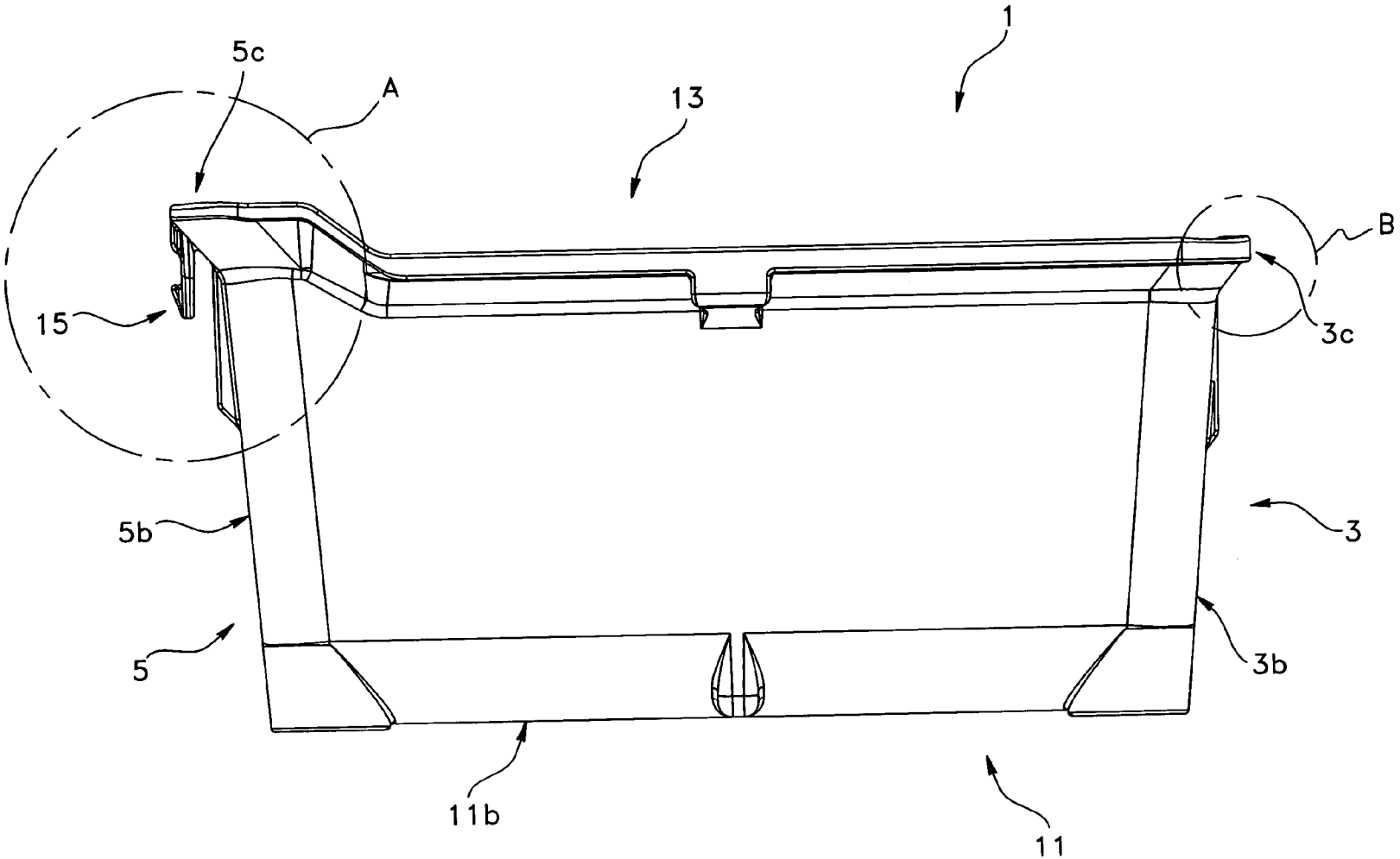
FIG. 2 is a left side view of what is shown in FIG. 1.
Figure 3:
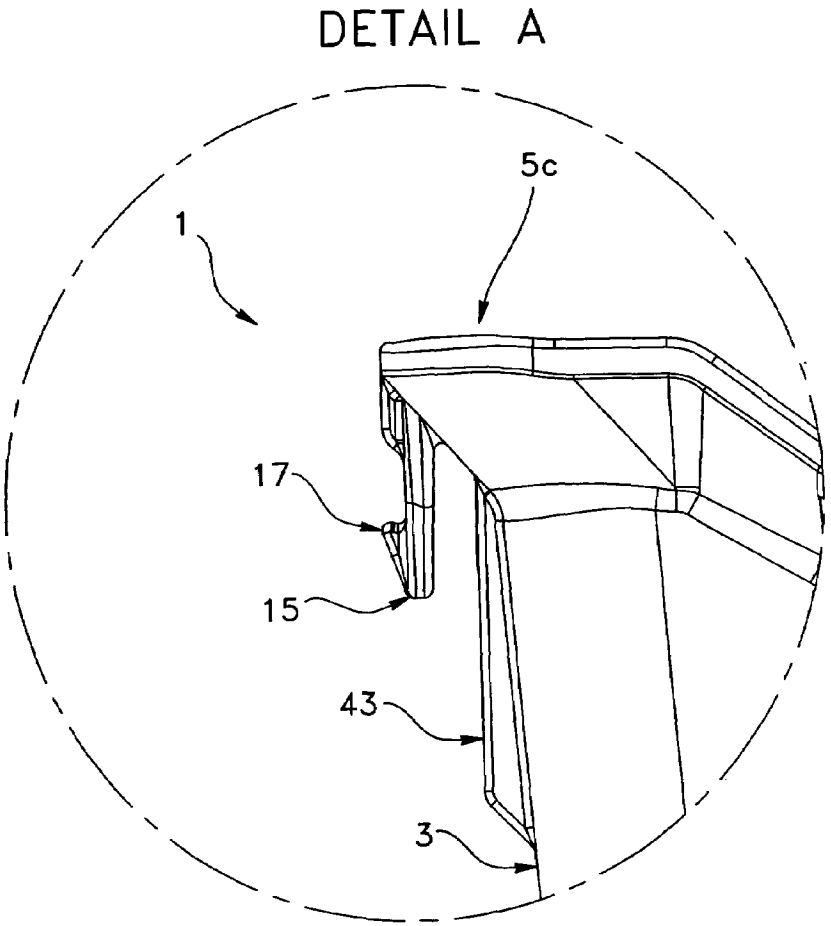
FIG. 3 is an enlarged portion of a portion (section A) of what is shown in FIG. 2.
Figure 4:
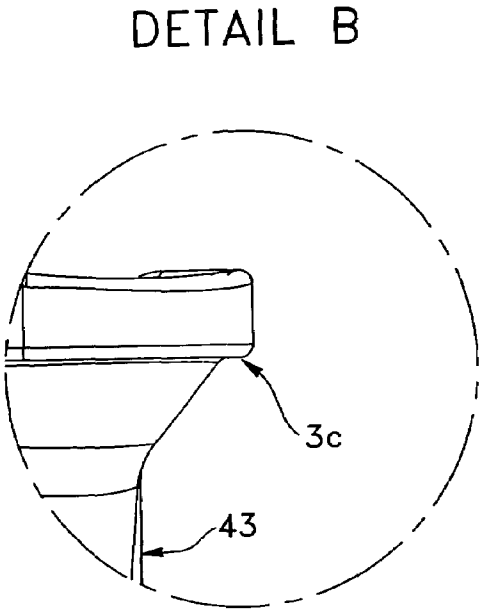
FIG. 4 is an enlarged portion of another portion (section B) of what is shown in FIG. 2.

As better shown in FIG. 3, the tongue 15 is preferably provided with a corresponding hook 17 shaped and sized for hooking onto the upper rim 3*c* of the front wall 3 of another one of such container 1, as can be easily understood when referring to FIG. 2, and when comparing FIG. 3 with FIG. 4.

Figure 5:
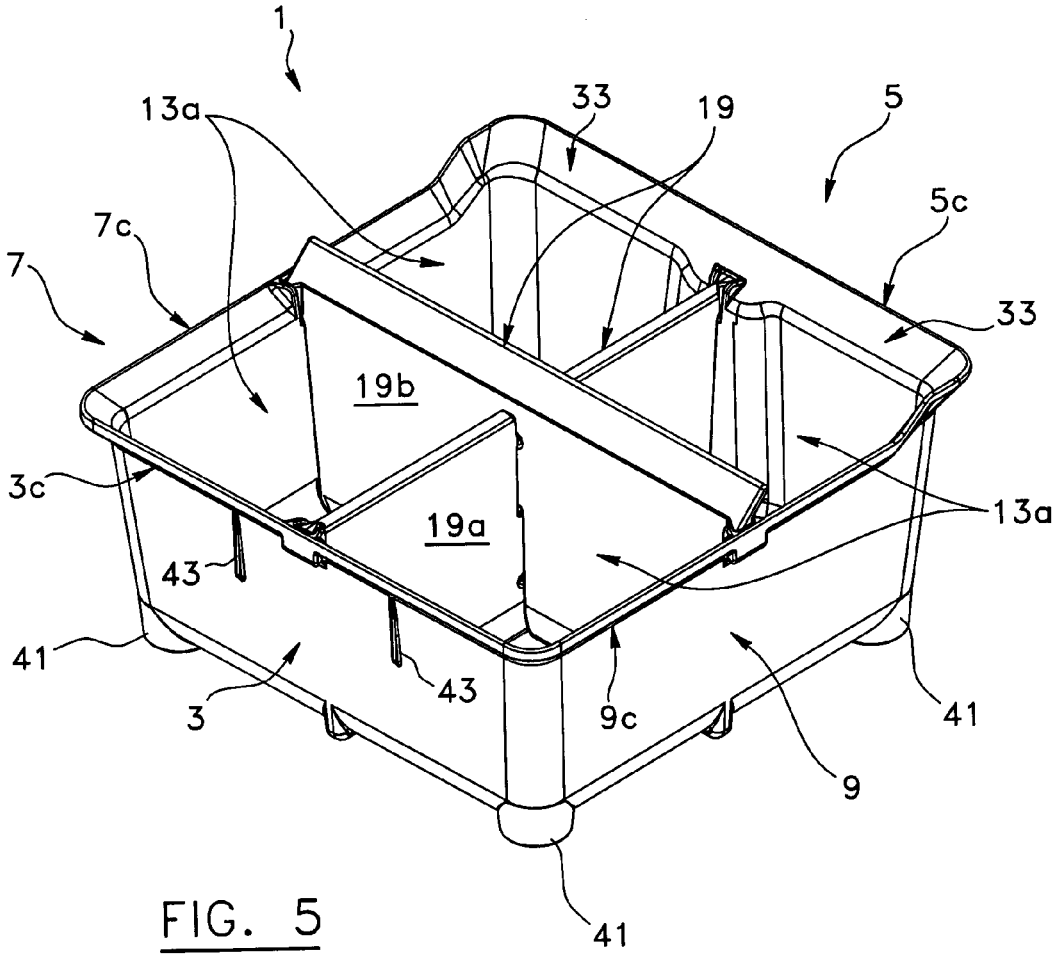
FIG. 5 is another front perspective view of what is shown in FIG. 1, the container being now shown with separators according to another preferred embodiment of the present invention.

According to another preferred embodiment of the present invention, the container 1 further comprises at least one separator 19, said at least one separator 19 being shaped and sized for inserting into the main storing space 13 of the container 1 for dividing said main storing space 13 into a pair of corresponding smaller storing spaces 13*a*, the at least one separator 19 being connectable onto opposite walls 3,5,7,9 of the container 1, as can be easily understood when contrasting FIGS. 7 and 5.

As better shown in FIG. 7, each opposite wall 3,5,7,9 comprise a slot 21 for receiving a bottom portion of the at least one separator 19 and a groove 23 for receiving an upper portion of the at least one separator 19. Preferably also, and as better shown In FIGS. 7, 8 and 9, each separator 19 comprises a pair of inserts 25 on opposite upper portions for inserting into corresponding grooves 23 of the opposite walls 3,5,7,9, said inserts 25 being complementary in shape to that of the grooves 23. According to the particular embodiment illustrated, the grooves 23 are preferably triangular-shaped. However, it is worth mentioning that other suitable geometrical configurations may be used according to the present invention so to ensure a secure and removable connection between the inserts 25 and corresponding grooves 23, as apparent to a person skilled in the art.

Each corresponding separator 19 may comprises an upper rim 27, this upper rim 27 being preferably positioned at a higher lever than the upper rim 3*c*, 7*c*, 9*c*, of the front, left and right walls 3, 7, 9. As better shown in FIG. 8, this upper rim 27 preferably extends rearwardly and preferably defines an inclined surface 29 which may be used for affixing information thereon, such as with a writing instrument (e.g. marker, pen, pencil, etc.) or a sticker, so to easily and conveniently identify the content of the corresponding storing space 13*a* associated to said upper rim, whether in front or in the back thereof, even if the container 1 is filled to capacity, as can be easily understood when referring to FIG. 6.

Figure 6:
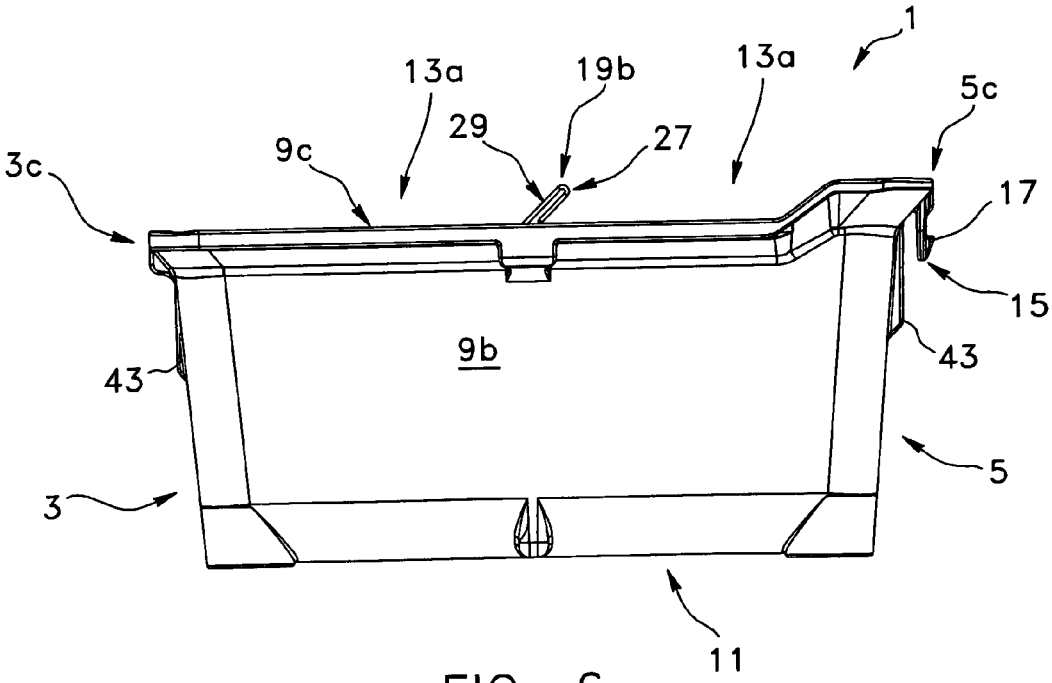
FIG. 6 is a right side view of what is shown in FIG. 5.

According to the preferred embodiment shown in FIGS. 5, 6 and 7, the container 1 preferably comprises first and second separators 19*a*,19*b*, the first separator 19*a* being connectable onto the front and rear walls 3,5 of the container 1, and the second separator 19*b* being connectable onto the left and right walls 7,9 of the container 1, and being also referred to as a "divider".

Preferably also, as can be easily understood when referring to FIGS. 5, 6, 8 and 9, the first and second separators 19*a*, 19*b* are each provided with a slit 31, the slit 31 of the first separator 19*a* being complementary to the slit 31 of the second separator 19*b* so as to enable said separators 19*a*,19*b* to be crossed into one another within the main storing space 13 of the container 1 so as to define four smaller storing spaces 13*a*, as better shown in FIG. 5.

Similarly to the aforementioned in regards to the upper rim 27 of the corresponding separator 19*b*, the upper rim 5*c* of the rear wall 5 is also preferably positioned at a higher lever than the upper rim 3*c*,7*c*,9*c* of the front, left and right walls 3,7,9. Preferably also, the upper rim 5*c* of the rear wall 5 is slanted rearwardly so a to define an inclined surface 33 which may be used for affixing information thereon, such as with a writing instrument (e.g. marker, pen, pencil, etc.) or a sticker, so to easily and conveniently identify the content of the corresponding storing space 13*a* associated to said upper rim 33, namely in front of it, even if the container 1 is filled to capacity, as can be easily understood when referring to FIGS. 1, 2, 5 and 6.

As better shown in FIGS. 1 and 7, the front and rear walls 3,5, and the left and right walls 7,9, are preferably operatively connected to the bottom floor 11 of the container 1 via rounded corners 35. This enables namely an easier picking up of smaller articles which may present in the corners 35, or an easier cleaning of said corners 35.

As can be easily understood when referring to FIGS. 1, 5 and 7, the front and rear walls 3,5, and the left and right walls 7,9, are operatively connected to one another so as to define an upper peripheral rim 37 of the container 1 and an opposite bottom peripheral rim 39 of the container 1, the upper peripheral rim 37 being shaped and sized to as to be complementary to the bottom peripheral rim 39 so as to enable a plurality of containers 1 to be stacked onto and nested into one another. Preferably also, the bottom peripheral rim 39 of the container 1 is rectangular-shaped with four corners, each of said corners being provided with a corresponding leg 41, preferably being designed for further increasing the stability of the container 1, when resting on a given surface, such as on a table or inside a drawer, for example.

Preferably also, and as better shown in FIGS. 1 and 5, either one of the outer surfaces of the front, rear, left and right walls 3,5,7,9 is provided with at least one rib 43 projecting from therefrom. Preferably, each wall 3,5,7,9 is provided with a plurality of such ribs 43, preferably extending vertically, as shown, so as to prevent a suction effect between neighboring containers 1, as can be easily understood by a person skilled in the art. For example, when a plurality of containers 1 are stacked onto and nested into one another, the ribs 43 of an upper container come into contact with the upper peripheral rim 37 of a lower container so that the upper container is prevented from being inserted too deep into the lower container and thereby prevent the suction effect.

Figure 8:
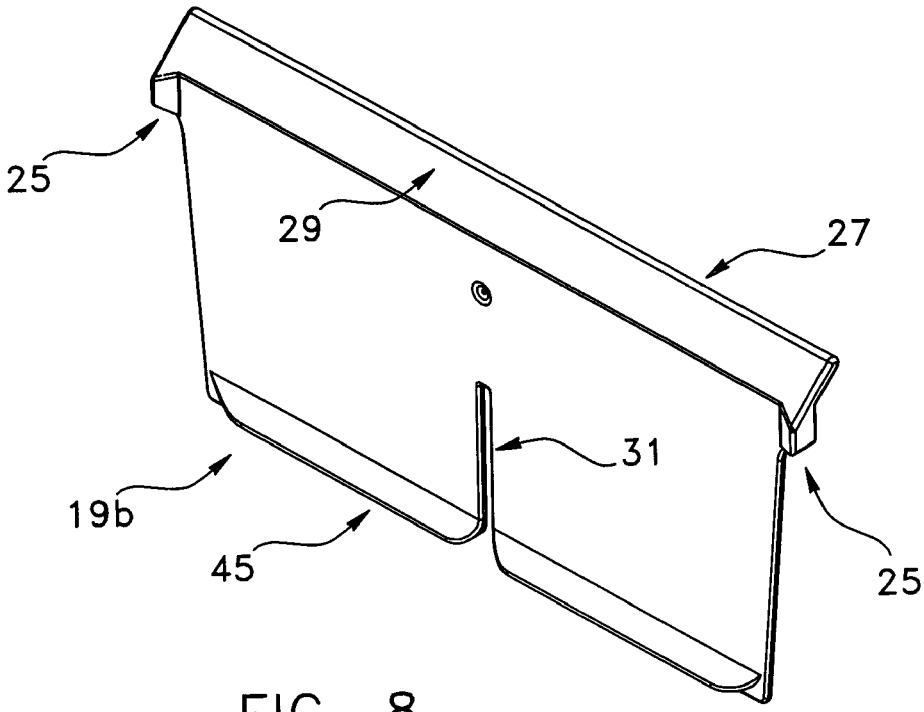
FIG. 8 is an enlarged perspective view of one of the separators shown in FIG. 7.
Figure 9:
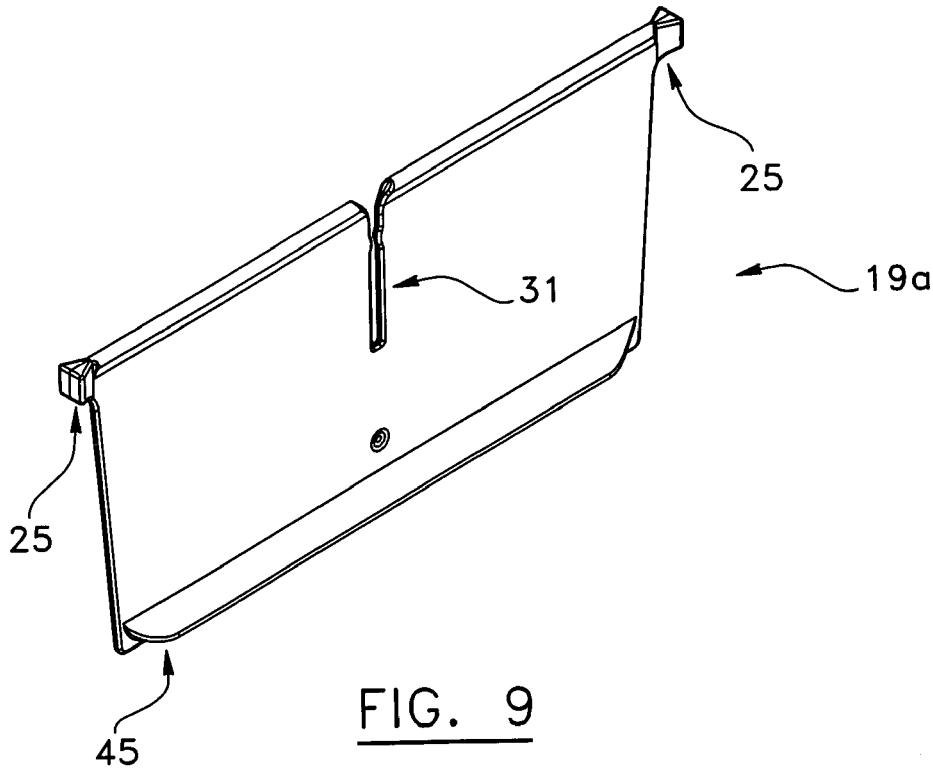
FIG. 9 is an enlarged perspective view of the other separator shown in FIG. 7.

Preferably also, and as better shown In FIGS. 7, 8 and 9, each separator 19*a*,19*b* is provided with an embossment flange 45 projecting from and extending along a portion of said separator 19, so to preferably increase the structural rigidity of the separator 19, despite, or at the very least to compensate for, the presence of the slit 31.

As can be easily understood from the above-described, the preferred embodiments of the container 1 illustrated in the accompanying drawings is preferably intended for minimizing components and assembling steps, while providing a suitable manner for easily, quickly and securely containing articles and/or displaying information relating to the content (s) thereof.

Preferably, the components of the multipurpose container 1 according to the present invention are made of suitable materials, such as polymeric materials, metallic materials, composite materials, etc., for properly sustaining the different loads to which the container 1 and corresponding parts may be subjected to, as apparent to a person skilled in the art. Preferably, the materials are selected so as to have properties which may be resistant to the environment in which the container 1 may be used, such as anti-corrosive properties for example in the case where the container 1 may be used in humid conditions and/or with articles which may be wet. Preferably, the materials are selected so as to have a surface finish which may be resistant to wear and tear, and which would enable an easy maintenance (e.g. cleaning) of the container 1, as also apparent to a person skilled in the art.

Moreover, according to another aspect of the present invention, there is also provided a kit for assembling a container 1 such as the one described and illustrated herein, as exemplified in the accompanying figures.

It is worth mentioning that according to yet another aspect of the present invention, there is also provided a method of storing at least one article, the method comprising the steps of a) providing a container 1 such as the one described and illustrated herein, as exemplified in the accompanying figures; b) separating the main storing space 13 of the container 1 into a plurality of smaller storing spaces 13*a* by means of at least one separator 19; and c) inserting the at least one article into one of said plurality of smaller storing spaces 13*a*. Preferably also, the method further comprises the step of d) labeling the content of a given storing space 13*a* of the container 1 by affixing an indication on a corresponding rim 27,5*c* of the container 1.

It is worth mentioning that, according to the present invention, some of the above-mentioned steps may be interchanged in order without affecting the proper operation/use of the container 1, as apparent to a person skilled in the art, and without departing form the scope of the present invention.

As may now be better appreciated, the present invention is a substantial improvement over other related containers known in the prior art in that, by virtue of its design and components (rims, rounded corners, legs, a tongue with hook, separators, corresponding slits, walls with slots and grooves, legs, ribs, etc.), the container 1 according to the present invention enables a greater variety of applications and/or uses than what is possible with storing containers of the prior art, as explained hereinabove.

Of course, numerous modifications could be made to the above-described embodiments without departing from the scope of the invention as defined in the appended claims.

The invention claimed is:

1. A container for storing at least one article, the container comprising:

opposite front and rear walls, each of said walls being provided with an inner surface and an outer surface, and having an upper rim, the upper rim of the front wall extending outward therefrom and having an underside;

opposite left and right walls, each of said walls being provided with an inner surface and an outer surface, and having an upper rim;

a bottom floor having an inner surface and an outer surface;

wherein the walls and bottom floor are operatively connected to one another to define a main storing space within the container for storing said at least one article;

a tongue extending longitudinally along the upper rim of the rear wall, said tongue further extending downwardly from said upper rim of the rear wall; and a hook projecting outward from the tongue away from the rear wall, the tongue being shaped and sized for hooking onto the underside of the upper rim of the front wall of another container.

2. A container according to claim 1, wherein the container comprises at least one separator, said at least one separator being shaped and sized for inserting into the main storing space of the container for dividing said main storing space into a pair of corresponding smaller storing spaces, the at least one separator being connectable onto opposite walls of the container.

3. A container according to claim 2, wherein each opposite wall comprises a slot for receiving a bottom portion of the at least one separator and a groove for receiving an upper portion of the at least one separator.

4. A container according to claim to claim 3, wherein the at least one separator comprises a pair of inserts on opposite upper portions for inserting into corresponding grooves of the opposite walls, said inserts being complementary in shape to that of the grooves.

5. A container according to claim 4, wherein the grooves are triangular-shaped.

6. A container according to claim 2, wherein the at least one separator comprises an upper rim, the upper rim of the at least one separator being positioned at a higher lever than the upper rim of the front, left and right walls.

7. A container according to claim 2, wherein the at least one separator comprises first and second separators, the first separator being connectable onto the front and rear walls of the container, and the second separator being connectable onto the left and right walls of the container.

8. A container according to claim 7, wherein the first and second separators are each provided with a slit, the slit of the first separator being complementary to the slit of the second separator so as to enable said separators to be crossed into one another within the main storing space of the container so as to define four smaller storing spaces.

9. A container according to claim 1, wherein the upper rim of the rear wall is positioned at a higher lever than the upper rim of the front, left and right walls.

10. A container according to claim 9, wherein the upper rim of the rear wall is slanted rearwardly so as to define an inclined surface.

11. A container according to claim 1, wherein the front and rear walls, and the left and right walls, are operatively connected to the bottom floor of the container via rounded corners.

12. A container according to claim 1, wherein the front and rear walls, and the left and right walls, are operatively connected to one another so as to define an upper peripheral rim of the container and an opposite bottom peripheral rim of the container, the upper peripheral rim being shaped and sized to as to be complementary to the bottom peripheral rim so as to enable a plurality of containers to be stacked onto and nested into one another.

13. A container according to claim 12, wherein the bottom peripheral rim of the container is rectangular-shaped with four corners, each of said corners being provided with a corresponding leg.

14. A container according to claim 1, wherein either one of the outer surfaces of the front, rear, left and right walls is provided with at least one rib projecting from therefrom.

15. A container according to claim 2, wherein the at least one separator is provided with an embossment flange projecting from and extending along a portion of said at least one separator.

16. A container for storing at least one article, the container comprising:

opposite front and rear walls, each of said walls being provided with an inner surface and an outer surface, and having an upper rim, the upper rim of the front wall extending outward therefrom and having an underside;

opposite left and right walls, each of said walls being provided with an inner surface and an outer surface, and having an upper rim; and a bottom floor having an inner surface and an outer surface;

wherein the walls and bottom floor are operatively connected to one another so as to define a main storing space within the container for storing said at least one article;

wherein the rear wall of the container comprises a tongue extending longitudinally along the upper rim of the rear wall, said tongue further extending downwardly from said upper rim of the rear wall and being shaped and sized for hooking the container onto a fixed structure via said tongue;

wherein the tongue is provided with a hook projecting outward from the tongue and away from the rear wall, which is shaped and sized for hooking onto the underside of the upper rim of the front wall of another container;

wherein the container further comprises first and second separators, the first separator being connectable onto the front and rear walls of the container, and the second separator being connectable onto the left and right walls of the container, the first and second separators being each provided with a slit, the slit of the first separator being complementary to the slit of the second separator so as to enable said separators to be crossed into one another within the main storing space of the container so as to divide said main storing space into four smaller storing spaces;

wherein each wall comprises a slot for receiving a bottom portion of a corresponding separator and a groove for receiving an upper portion of said corresponding separator;

wherein each separator comprises a pair of inserts on opposite upper portions for inserting into corresponding grooves of opposite walls, said inserts being complementary in shape to that of the corresponding grooves, and said corresponding grooves being triangular-shaped;

wherein the second separator comprises an upper rim, the upper rim of the second separator being positioned at a higher lever than the upper rim of the front, left and right walls;

wherein the upper rim of the rear wall is positioned at a higher lever than the upper rim of the front, left and right walls;

wherein the front and rear walls, and the left and right walls, are operatively connected to the bottom floor of the container via rounded corners; and wherein either one of the outer surfaces of the front, rear, left and right walls is provided with at least one rib projecting therefrom.

17. A kit for assembling a container for storing at least one article, the kit comprising:

a container such as the one defined in claim 1; and at least one separator, said at least one separator being shaped and sized for inserting into the main storing space of the container for dividing said main storing space into a pair of corresponding smaller storing spaces, the at least one separator being connectable onto opposite walls of the container.

18. A container according to claim 1, wherein the hook extends outwardly and upwardly from the tongue.

19. A contain according to claim 1, wherein the upper rim of the left wall, the right wall and the front wall are at a same height.

20. A container according to claim 16, wherein the hook extends outwardly and upwardly from the tongue.

* * * * *